US009567173B2

(12) United States Patent
Harris et al.

(10) Patent No.: US 9,567,173 B2
(45) Date of Patent: Feb. 14, 2017

(54) SHEET FEEDERS

(75) Inventors: Graham Michael Harris, Countersthorpe (GB); Paul Graham Barrett, Narborough (GB)

(73) Assignee: CreaseStream LLP, Leicestershire (GB)

( * ) Notice: Subject to any disclaimer, the term of this patent is extended or adjusted under 35 U.S.C. 154(b) by 299 days.

(21) Appl. No.: 14/359,015

(22) PCT Filed: Nov. 16, 2011

(86) PCT No.: PCT/GB2011/052241

§ 371 (c)(1), (2), (4) Date: Sep. 12, 2014

(87) PCT Pub. No.: WO2013/072648

PCT Pub. Date: May 23, 2013

(65) Prior Publication Data

US 2015/0035223 A1 Feb. 5, 2015
US 2015/0321865 A9 Nov. 12, 2015

(51) Int. Cl.

| | |
|---|---|
| ***B65H 5/02*** | (2006.01) |
| ***B65H 3/04*** | (2006.01) |
| ***B65H 3/52*** | (2006.01) |
| ***B65H 3/56*** | (2006.01) |
| ***B65H 1/06*** | (2006.01) |

(52) U.S. Cl.

CPC ..... *B65H 5/026* (2013.01); *B65H 1/06* (2013.01); *B65H 3/04* (2013.01); *B65H 3/042* (2013.01); *B65H 3/5238* (2013.01); *B65H 3/56* (2013.01)

(58) Field of Classification Search

CPC ..... B65H 3/042; B65H 3/523; B65H 3/5238; B65H 5/026; B65H 1/06; B65H 3/56; B65H 3/04

USPC ..... 271/35

See application file for complete search history.

(56) References Cited

U.S. PATENT DOCUMENTS

| | | | | |
|---|---|---|---|---|
| 3,151,863 A * | 10/1964 | Lohr | G06K 13/10 271/121 |
| 3,664,660 A | 5/1972 | Runzi | |
| 4,555,103 A | 11/1985 | Larson | |
| 4,718,809 A * | 1/1988 | Krasuski | B65H 3/063 271/121 |
| 2009/0134564 A1 | 5/2009 | Kaiping | |

FOREIGN PATENT DOCUMENTS

| | | |
|---|---|---|
| EP | 0043262 A1 | 1/1982 |
| JP | 2001335175 A | 12/2001 |

* cited by examiner

*Primary Examiner* — David H Bollinger

(74) *Attorney, Agent, or Firm* — Reinhart Boerner Van Deuren P.C.

(57) ABSTRACT

A sheet feeder comprises a feed deck for supporting a stack of sheets (65) to be fed. The feed deck may be formed by a bed of freely spinning rollers. A feed block (62) comprises a friction pad (66) that projects from the bottom of the feed block (62) towards a drive belt (42) to define a gate therebetween. The drive belt (42) frictionally engages the underside of a bottom sheet of the stack (65) and urges the sheet towards the gate. The feed block (62) comprises a front face (72) immediately upstream from the gate, which is inclined at a sharp angle to the feed direction. The friction pad (66) comprises a lower face that is substantially parallel to the feed direction and does not intersect the plane of the feed block front face (72).

22 Claims, 7 Drawing Sheets

SHEET FEEDERS

FIELD OF THE INVENTION

The invention relates to sheet feeder apparatus, which separates sheets of paper or card from a stack and feeds them individually from the apparatus in a direction parallel to the plane of the sheets. The sheet feeder may be part of a device for processing the paper, for example by creasing, perforating or cutting it between a pair of rollers or it may simply deliver the individual sheets to a separate device for further processing. The nature of the downstream operation does not form part of the present invention.

The sheets handled by the feeder may comprise paper or cardboard, for example in the density range 50 g/m$^2$ to 500 g/m$^2$, or other similar materials such as thin plastics. For simplicity, and without limitation, the material will be referred to hereafter as "paper".

BACKGROUND OF THE INVENTION

Sheet feeders are known that use a drive means such as a belt or roller to remove a single sheet laterally from the bottom of a stack of sheets that rests on a feed deck. The bottom sheet resists separation from the stack owing to friction with the next sheet in the stack above it and with the non-moving parts of the feed deck below it. In order for the sheet to slide away from the stack, the grip between the sheet and the drive means must exceed those frictional forces. Ideally, that should be true whether the bottom sheet is weighed on by a full stack or by only a few sheets.

Friction between the moving sheet and the stationary parts of the feed deck has a tendency to cause scuff marks on the surface of the paper. That is a particular problem with the increasing use of digital printing on paper with a smooth surface.

Some sheet feeders have used suction drums to improve the grip between the drive means and the paper. The surface of a suction drum is perforated by holes and an air pump is provided to suck air from the interior of the drum so that the paper clings to the drum's surface. The air pump may also be used to direct a jet of air towards the edge of the stack in order to assist with separating the sheets of the stack. However, such air pumps add to the bulk and complexity of the sheet feeder as well as its running costs and noise levels.

A sheet feeder should be able to deliver the sheets as fast as possible, up to the maximum operating speed of any downstream processing apparatus. It should reliably deliver only a single sheet at a time because a misfeed in which two sheets are delivered together will at best not be processed properly downstream and may at worst jam the apparatus, causing a costly delay in workflow.

SUMMARY OF THE INVENTION

In a first aspect, the invention provides a sheet feeder comprising: a feed deck for supporting a stack of sheets to be fed; a feed block; a drive belt for frictionally engaging the underside of a bottom sheet of the stack and urging the sheet along a feed direction below the feed block; the feed block comprising a friction pad that projects from the bottom of the feed block towards the drive belt to define a gate therebetween and a first front face immediately upstream from the gate, the first front face defining a plane inclined at a first angle to the feed direction, wherein the friction pad does not intersect the plane of the first front face.

A sheet feeder made in accordance with the invention is found to feed single sheets rapidly and reliably over a wide range of paper thicknesses and a wide range of stack heights. It runs quietly because it does not rely on air pumps and it reduces scuffing of the surface of the sheets.

The first angle may be less than 45° and is preferably between 25° and 30°.

The feed block may further comprises a second front face upstream from the first front face, the second front face being inclined to the feed direction at a second angle that is greater than the first angle.

The feed block may further comprise a lower face, which is located downstream from the first front face and which faces the drive belt, the friction pad projecting from the bottom of the feed block below the lower face. Preferably the lower face of the feed block defines a plane that is substantially parallel to the feed direction; the feed block further comprising a curved surface that effects a smooth transition from the first front face to the lower face. A suitable material for the feed block is aluminium or an aluminium alloy; and at least the first front face of the feed block may be anodized.

The friction pad preferably comprises a pad lower face that is substantially parallel to the feed direction. It may further comprises a pad front face that adjoins an upstream end of the pad lower face, the pad front face being inclined at an angle of less than 45° to the feed direction where it adjoins the pad lower face.

In a preferred sheet feeder according to the invention, a pair of the drive belts are positioned on opposite sides of a centreline of the feeder and pair of the feed blocks are aligned with respective ones of the drive belts.

The pair of feed blocks may be mounted on a common bracket, which is in turn mounted on a frame of the sheet feeder. Means may be provided for adjusting the height of at least one of the feed blocks relative to the bracket or for adjusting the height of the bracket relative to the frame.

In a second aspect, the invention provides a sheet feeder comprising: a feed deck for supporting a stack of sheets to be fed; a feed block; and drive means for frictionally engaging the underside of a bottom sheet of the stack and urging the sheet along a feed direction at a first speed through a gate defined between the feed block and the drive means; the sheet feeder further comprising a counter-rotating pair of acceleration rollers downstream from the gate for gripping a sheet between them and urging the sheet away from the gate at a second speed higher than the first speed. The second speed may be at least twice the first speed and is preferably about five times the first speed.

The increase in the speed at which the sheets are transported causes gaps to open up between successive sheets, which can improve their handling downstream of the sheet feeder.

In a third aspect, the invention provides a sheet feeder comprising: a feed deck for supporting a stack of sheets to be fed; a feed block; and drive means for frictionally engaging the underside of a bottom sheet of the stack and urging the sheet along a feed direction through a gate defined between the feed block and the drive means; wherein the feed deck is inclined to the horizontal and wherein the feed deck comprises a plurality of feed rollers, each of which is free to spin about a generally horizontal axis.

By allowing the moving sheets to travel on freely spinning rollers in the areas where they are not in contact with the guide means, the reliability of feeding the sheets is improved and scuffing of their surface is reduced.

The sheet feeder may further comprise at least one guide plate arranged in a vertical plane and transversely to a series of the rollers, the series of rollers defining a plane of the feed deck that is tangent to the tops of the rollers; wherein a lower edge of the guide plate projects below the plane between adjacent pairs of the rollers.

In a fourth aspect, the invention provides a sheet feeder comprising: a feed deck for supporting a stack of sheets to be fed; a feed block; and drive means for frictionally engaging the underside of a bottom sheet of the stack and urging the sheet along a feed direction through a gate defined between the feed block and the drive means; wherein the drive means is part of a removably mounted unit in the feed deck. This permits worn parts of the drive means, such as belts or rollers, to be replaced easily and in a short time.

Preferably, the drive means unit comprises means at one end of the unit for pivotally mounting the unit in the feed deck; and means at the other end of the unit for fastening the unit to the feed deck. The pivotal mounting means may comprise jaws on the drive unit for engaging a rod on the feed deck, or vice versa. The drive unit may also comprise a first gear for engaging a second gear below the feed deck, from which power for the drive means is derived.

DRAWINGS

DETAILED DESCRIPTION

Figure 1:
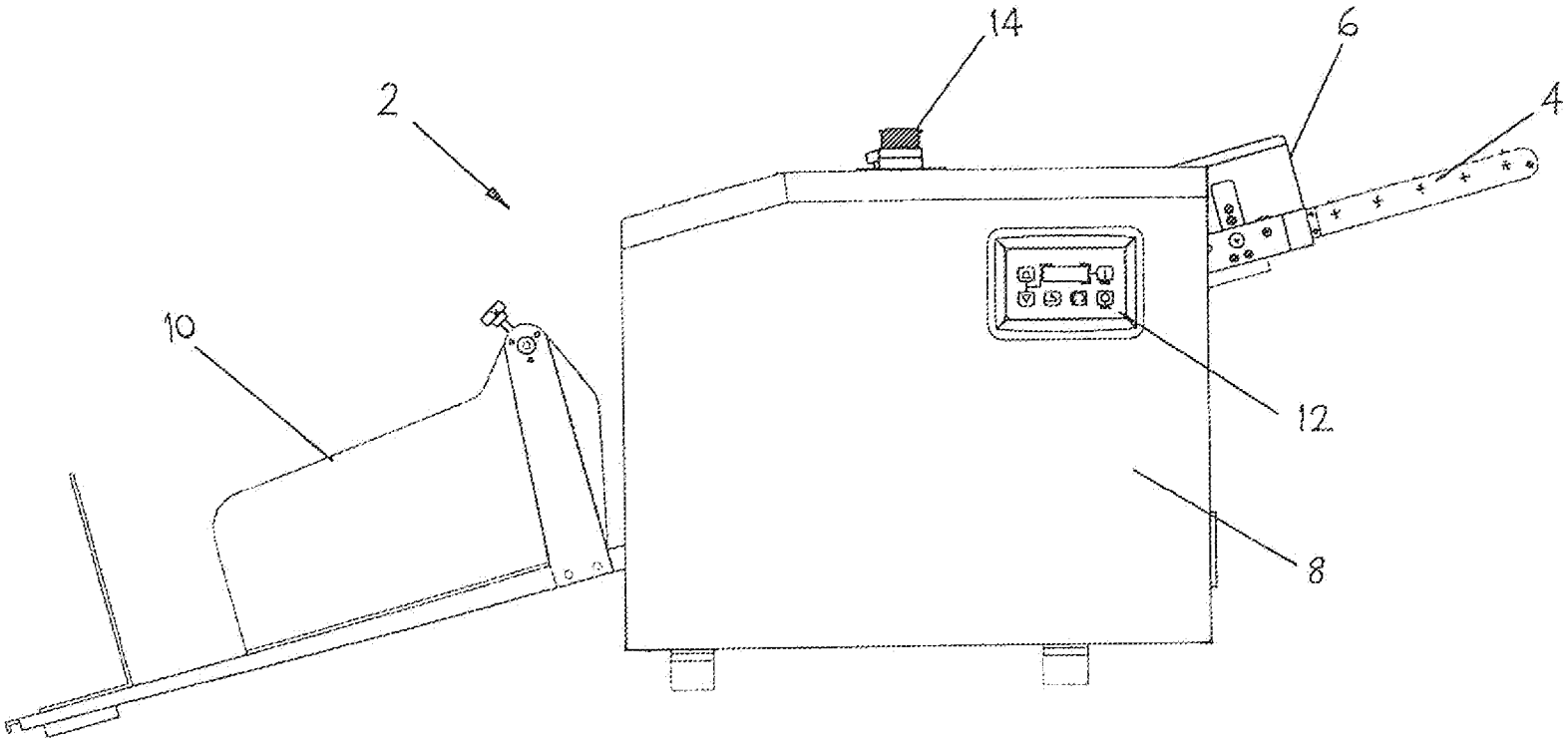
FIG. 1 is a side elevation of a paper creasing machine, which includes a sheet feeder in accordance with the invention.

FIG. 1 shows a machine 2 for creasing, perforating or cutting sheets of paper from a stack. A stack of paper to be processed (not shown) is placed on a feed deck 4, supported by side guides 6. A sheet feeder device in accordance with the present invention separates individual sheets of paper from the bottom of the stack and feeds them into the body 8 of the machine 2 along the plane of the feed deck 4. After a processing operation such as creasing, perforating or cutting by the machine 2, the processed sheets are collected as an output stack in an output bin 10. Alternatively, the processed sheets could be delivered individually on rollers to other machinery for further operations to be carried out.

A control panel 12 allows an operator to control aspects of the operation of the machine 2, such as its speed, in a conventional manner. An emergency stop button 14 is provided in a prominent and easily accessible location.

Figure 2:
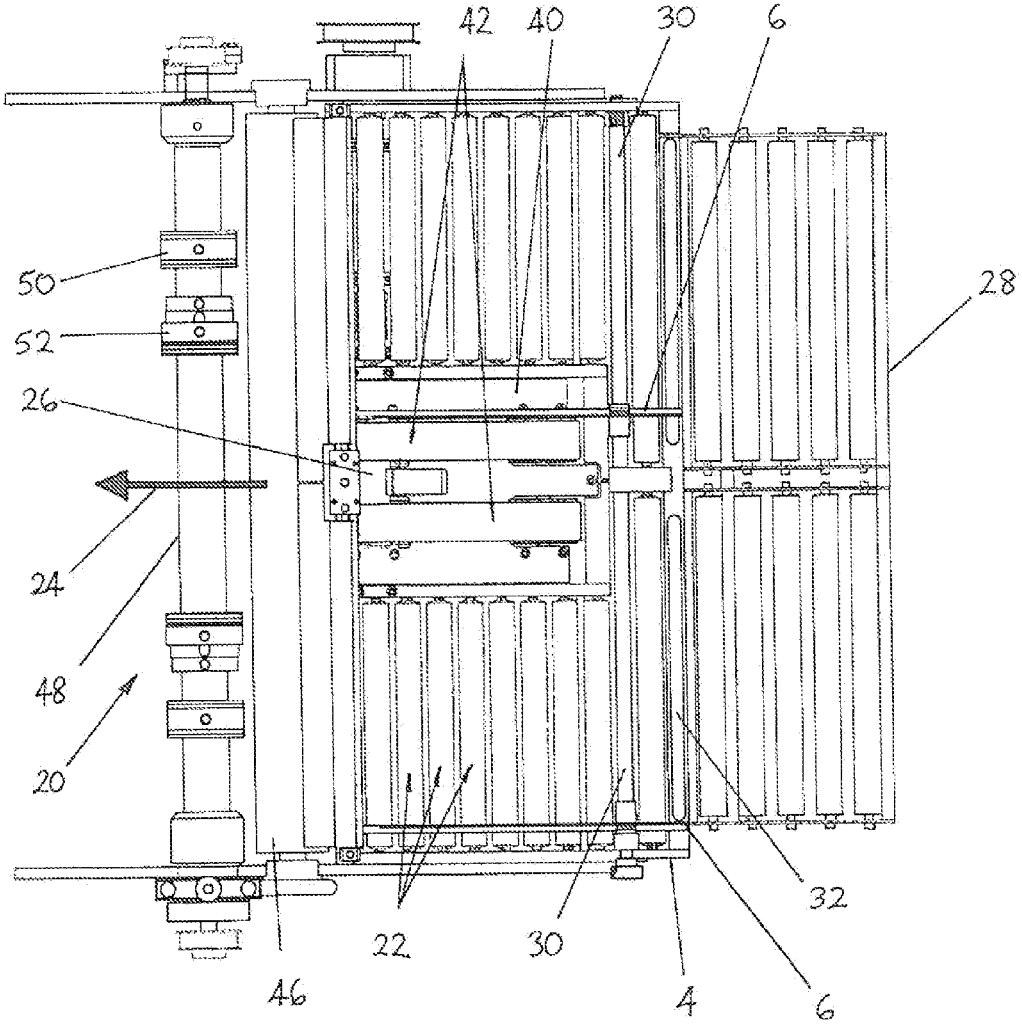
FIG. 2 is a plan view of part of the machine shown in FIG. 1.

FIG. 2 is a plan view of the sheet feeder of the creasing machine 2, also showing the creasing device 20 but not the output bin 10. The feed block (described below) that defines the gate 26 of the sheet feeder is also omitted to show details of the drive unit 40. A stack of paper (not shown in FIG. 2) rests on the feed deck 4 overlapping the drive unit 40, which acts on the lowest sheet of the stack to feed the sheet into the machine in the direction marked by an arrow 24. The drive mechanism of the sheet feeder will be explained in more detail below but in FIG. 2 it can be seen that the drive unit 40 comprises a pair of drive belts 42 with upper surfaces that lie generally in the plane of the feed deck 4.

The majority of the surface of the feed deck 4 is formed by sets of feed rollers 22. There are sets of feed rollers 22 to each side of the drive unit 40 to support the areas of the paper in the stack that do not overlie the drive unit. Each of the rollers 22 is mounted so that it can spin freely about its axis, with minimal resistance. The axes of the rollers 22 are generally horizontal and are perpendicular to the direction in which the sheets move. Because the plane of the feed deck 4 is inclined from the horizontal, as shown in FIG. 1, a stack of paper placed on the feed deck 4 will roll down the slope of the deck towards the position of the gate 26 of the sheet feeder.

An upstream part of the feed deck 4 may be formed as a removable extension 28, which at the user's option can be present in order to allow larger sheets of paper to be stacked or can be absent in order to reduce the footprint of the machine 2. The removable extension 28 comprises further sets of rollers 22. Over the majority of the feed deck 4, the surface is thus defined by feed rollers 22. Wherever any significant level of friction occurs between a sheet and a roller, the free-spinning roller can simply rotate to follow the movement of the sheet and thus scuffing of the sheet's surface is substantially avoided.

The sides of the stack on the feed deck 4 are supported by a pair of side guides 6. The side guides 6 are generally vertical plates orientated in a plane parallel to the feed direction 24. The guides 6 can be moved transversely to the feed direction along transverse rods 30 (only one of which is visible in FIG. 2) in order to adapt to paper stacks of various widths. Conventional means may be provided to release the guides 6 for sliding along the rods 30 and then to lock them again in the desired position. Although in FIG. 2 the two side guides 6 are both displaced to their maximum extent in the same direction, in normal operation the two guides 6 would be spaced equidistantly on either side of the centreline of the sheet feeder, in order that the fed sheets should be centred on the drive unit 40 and be drawn through the device without any off-centre forces. A scale 32 marked in suitable units with measurements of distance away from the centreline can be provided to assist the operator with positioning the guides 6. A known balancing mechanism (not shown) may also be provided to keep the guides positioned symmetrically about the centreline.

Figure 6:
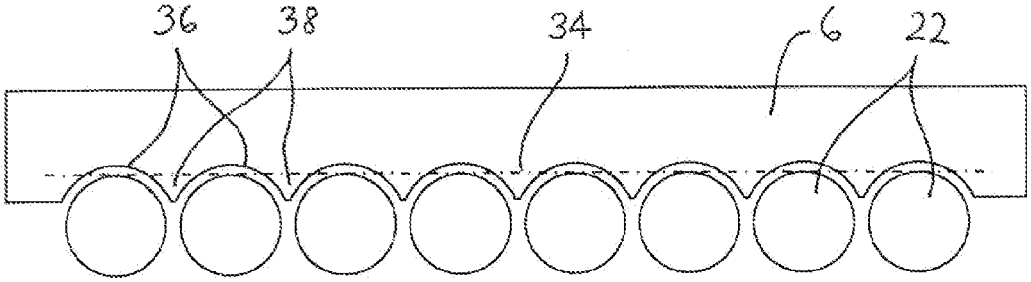
FIG. 6 is a schematic elevation of a side guide of the machine shown in FIG. 1.

Conventional side guides often have an L-shaped cross-section so that the edges of the bottom sheet of the stack rest on inwardly directed horizontal portions of the guides. In the present apparatus it is preferred that the side guides 6 should have no horizontal portions in order that the bottom of the stack should make maximum contact with the feed rollers 22. FIG. 6 shows schematically the relationship between the bottom of the side guides 6 and a set of the rollers 22. It does not attempt to show the mechanisms by which the guides 6 or rollers are mounted. The rollers 22 in the set define a plane 34 that is tangent to the tops of the rollers, which is the plane in which the bottom sheet of the stack is supported. The lower edge of the side guide 6 comprises an alternating series of cut-outs 36 and cusps 38. Each of the cut-outs 36 is preferably in the form of a circular arc that is concentric with the axis of an associated roller 22 to provide sufficient clearance around that roller so that its rotation is not impeded. Each cusp 38 may come to a sharp point or it may be blunt, provided that the tip of the cusp extends below the plane 34 between a pair of adjacent rollers.

Thus the set of cusps 38 are able to provide guidance for the stack down to the bottom sheet of paper, which rests in the plane 34. If the lower edge of the side guide 6 was straight, it would have to be positioned at a height above the plane 34 sufficient to clear the tops of the rollers, which would leave room for at least the bottom sheet in the stack to drift sideways, beneath the guide 6. The cut-outs are not necessarily formed by cutting: any suitable process such as stamping or moulding may be used. The shape of the lower edge of the side guide 6 need not match that shown in the drawings: the important feature is that above the rollers 22 the guide should not interfere with their rotation and that between adjacent pairs of rollers the guide should project below the plane 34.

Reverting to FIG. 2, there can also be seen one of a pair of acceleration rollers 46, which are located one above the other and downstream from the gate 26 of the sheet feeder. A sheet of paper having been drawn through the gate 26 by the drive belts 42 is fed between the counter-rotating acceleration rollers 46, which grip the sheet between them and urge it away from the gate 26 at an increased speed.

The acceleration rollers 46 deliver the sheet of paper to the creasing device 20, where it is fed between a pair of counter-rotating shafts 48, one of which is visible in FIG. 2. Mounted on the shafts 48 are drums 50, which have frictional surfaces to grip the sheet between them and draw it through the creasing device at the same speed as it left the acceleration rollers 46. Also mounted on the shafts 48 are processing drums 52, which may comprise respective male and female drums for creasing, perforating or cutting the sheet between them in a known manner. The positions of the drums 50,52 along their respective shafts 48 can be changed to adapt to the width of the sheets of paper and to the desired positions of the creases, perforations or cuts. On exiting the creasing device 20, the sheets are delivered to the top of the output bin 10 (FIG. 1), where they collect in an output stack.

The acceleration rollers 46 preferably run at a high speed relative to the speed of the drive belts 42. For example, they may accelerate the sheets of paper to five times the speed at which they are driven by the drive belts 42. Paper is delivered more-or-less continuously from the stack by the drive unit 40 so that the front edge of one sheet closely follows the rear edge of the preceding sheet through the gate 26. The acceleration of the sheets by the acceleration rollers 46 causes a gap to open up between successive sheets, which may be useful in downstream processing. For example, if instead of being collected in the output bin 10, the output sheets are to be delivered one at a time to a second machine, it is sometimes the case that the second machine requires its input feed path to be arranged perpendicularly to the output feed path of the present creasing machine. A gap between successive sheets allows time for one sheet to change direction and clear the feed path before the next sheet arrives.

Figure 3:
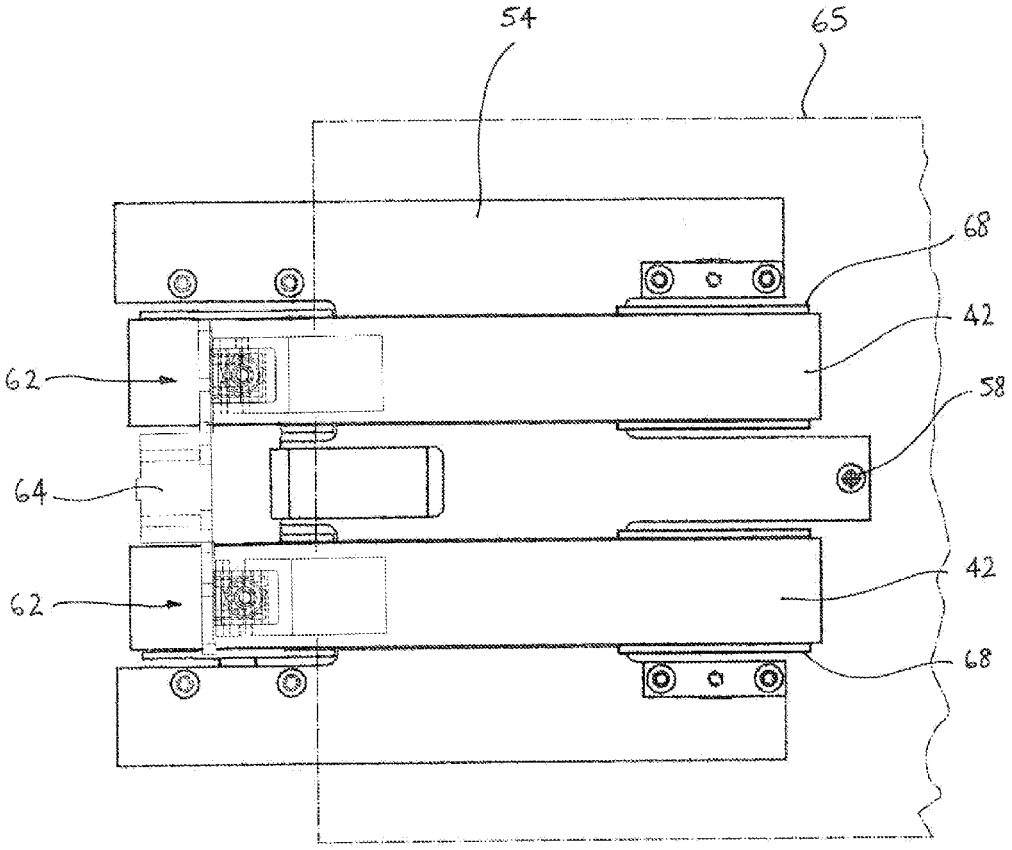
FIGS. 3, 4 and 5 are respectively a plan view, a side elevation and a front elevation of the drive unit and feed block of the machine shown in FIG. 1.
Figure 4:
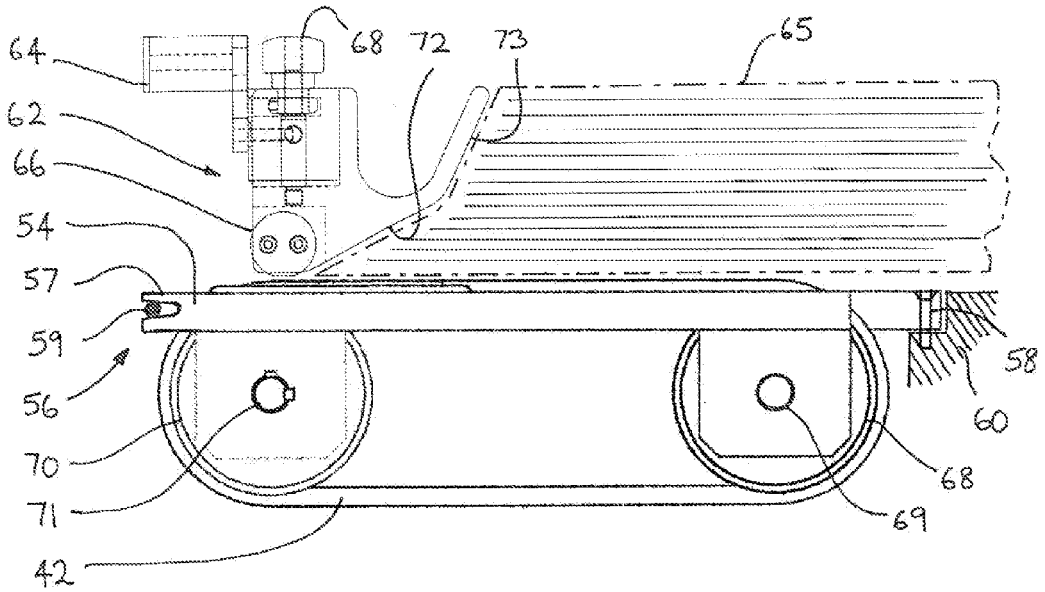
Figure 5:
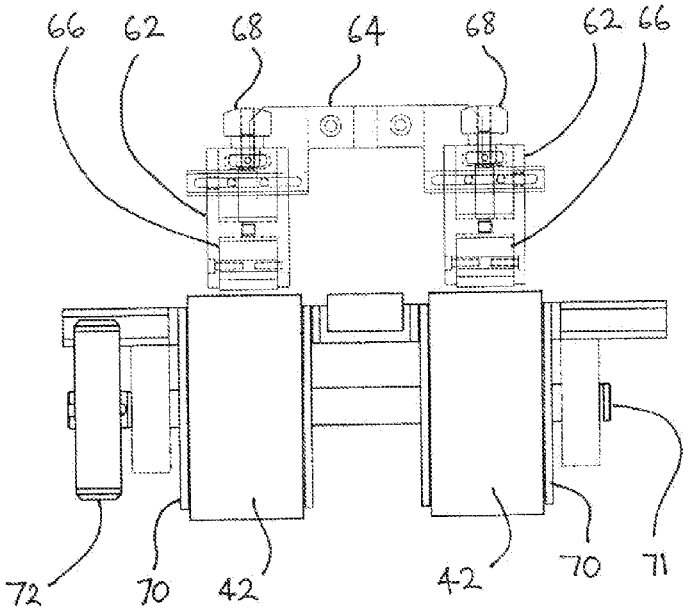

FIGS. 3, 4 and 5 show in more detail the removable drive unit 40 of the sheet feeder. The two drive belts 42 are spaced at equal distances from the centreline, on opposite sides of it. Each belt forms a continuous loop around first and second drums 68,70. The pair of first drums 68 is mounted on a common first shaft 69 beneath the feed deck 4, upstream of the gate 26. The pair of second drums 70 is mounted on a common second shaft 71 at a corresponding level but slightly downstream of the gate. The second shaft 71 carries a gear 72, which is driven by a motor (not shown) to rotate both shafts 69,71 and drive the belts 42. The shafts 69,71 are rotated in the anti-clockwise direction as viewed in FIG. 4, in order to drive the belts 42 along the feed deck 4 towards and through the gate 26. The belts 42 are made of rubber or a similar material that makes sufficient frictional contact with the overlying paper, such that frictional forces holding the bottom sheet against the next sheet in the stack are overcome and the sheet is carried by the belts 42 through the gate 26.

The drive unit 40 comprising the drive belts 42 is supported by a frame 54. The frame 54 has a latch 56 at one end and a fixing screw 58 at the other end, whereby unfastening of the fixing screw 58 allows the entire drive unit 40 to be quickly removed from the creasing machine 2, for example so that worn drive belts 42 can be quickly replaced. The latch 56 comprises a pair of fixed jaws 57 that can respectively engage with and pivot about a pair of rods 59 that form part of the substructure 60 of the feed deck 4. Alternatively, the rods 59 could be located on the removable drive unit 40 and the jaws 57 on the substructure 60. The drive unit can thus be removed from the feed deck 4 by unscrewing the single fixing screw 58, lifting the upstream end of the unit 40 to pivot the jaws 57 of the unit about the rods 59 until the upstream end is clear of the deck 4, then withdrawing the unit 40 along its length, generally in the upstream direction, to free the jaws 57 from the rods 59. The operation can be reversed to replace the drive unit 40. When the drive unit is in its installed position, the first gear 72 comes into engagement with a second gear (not shown) that is mounted beneath the feed deck 4 and that provides rotary power to the drive unit 40 from the motor (not shown).

The delivery of sheets of paper from the stack is controlled by a pair of feed blocks 62 that are mounted by a bracket 64 on a frame of the sheet feeder so that each feed block 62 is suspended above a respective one of the drive belts 42. A friction pad 66 projects from the bottom of each feed block 62 towards the associated drive belt 42 to define the gate 26 therebetween, through which only one sheet at a time can pass. The size of the gate 26 (i.e. the vertical gap between the friction pad 66 and the belt 42) can be manually adjusted by using knobs 68 to turn a to screw thread connection between each feed block 62 and the bracket 64, thereby raising or lowering the feed block 62. The gate 26 is most easily set to the correct value for the thickness of paper to be processed by opening the gate, inserting a sheet of the paper between the friction pad 66 and the drive belt 42 and then closing the gate until the sheet is almost trapped. This ensures that no more than one sheet of paper at a time can pass through the gate. The adjustment knobs 68 are easily accessible during use of the machine so the size of the gate 26 can be fine-tuned during operation.

An alternative arrangement (not illustrated) is possible, in which the vertical position of the bracket 64 is adjustable relative to the frame of the machine, preferably by means an adjustment knob similar to those illustrated. It is preferred that at least one of the feed blocks 62 should still be adjustable relative to the bracket in order that independent adjustment of the two feed blocks 62 remains possible, for example in case the two drive belts 42 should wear down at different rates.

A front face 70 of each feed block 62 faces upstream towards the feed deck 4. When a stack of sheets 65 is placed on the feed deck 4, as shown schematically by dot-dash lines in FIG. 4, the stack slides on the feed rollers 22 down the inclined surface of the feed deck 4 until the front edges of the sheets in the stack 65 come to rest against the front face 70 of the feed block 62. The front face 70 at least partly forms an acute angle with the plane of the feed deck 4, which allows the lower sheets in the stack to travel further than the upper sheets and deforms at least the lower part of the stack 65 into a wedge. Successive sheets in the stack are thereby slightly offset from one another along the feed direction 24, which begins the process of separating them to pass individually through the gate 26. It is preferred that a first, lower portion 72 of the front face 70 is inclined at an angle of less than 45° to the feed deck and preferably at between 25° and 30°. A second, upper portion 73 of the front face which merges smoothly into the lower portion 72, need not be inclined at such a sharp angle. The angle between the upper portion 73 and the feed deck 4 may suitably be anywhere between 45° and 90° but a value between 60° and 70° is preferred.

Figure 7:
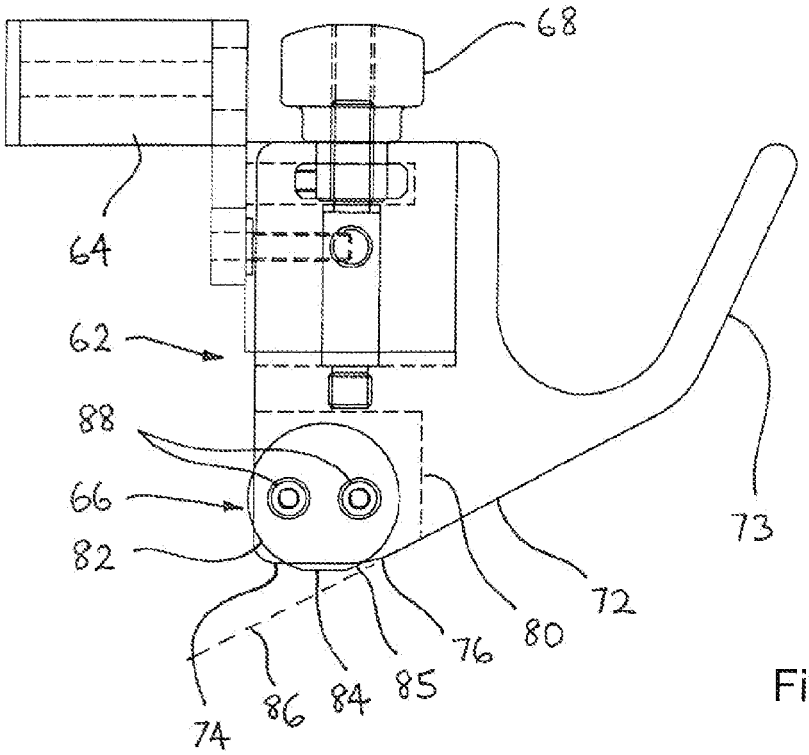
FIGS. 7, 8 and 9 are respectively a side elevation, a plan view and a front elevation of the feed block and mounting bracket of the machine shown in FIG. 1.
Figure 8:
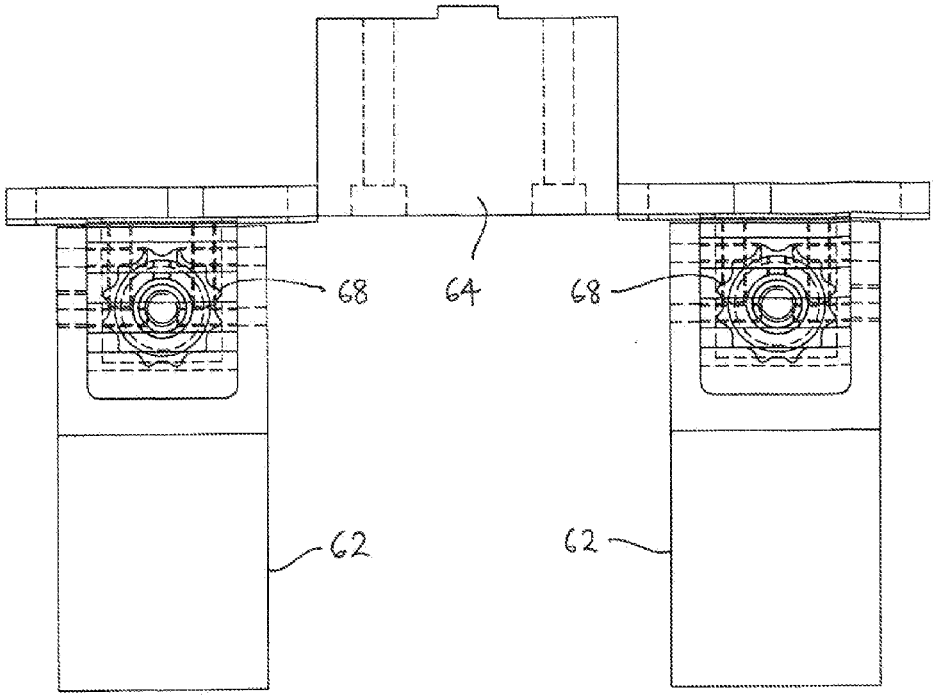
Figure 9:
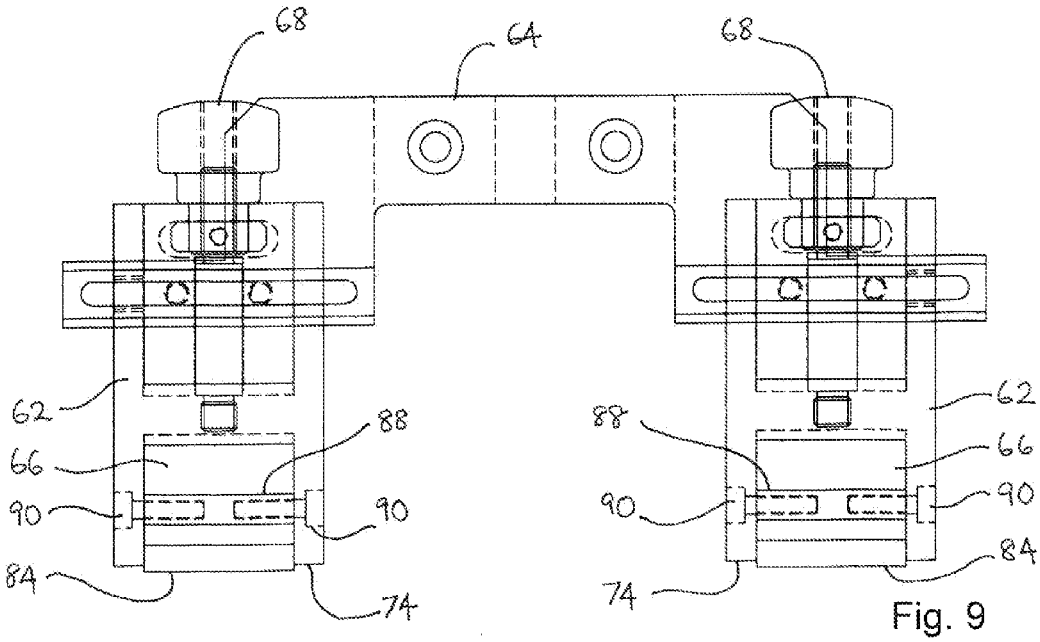
Figure 10:
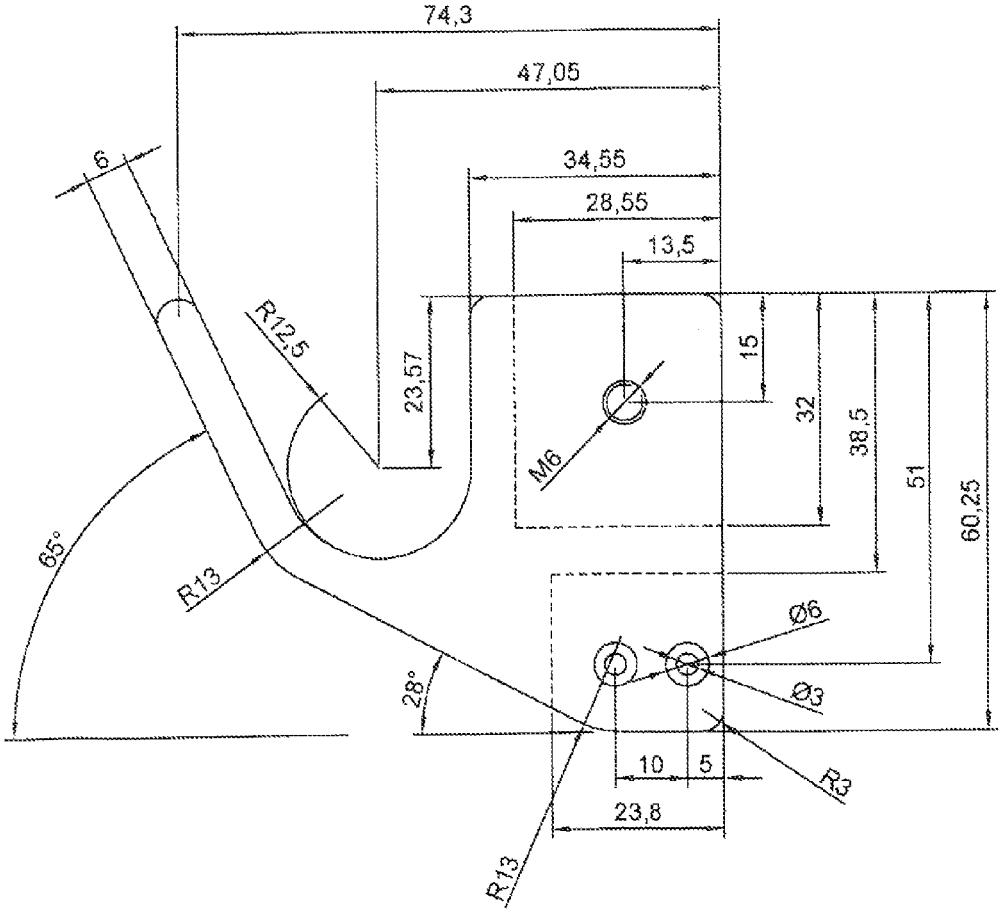
FIGS. 10 and 11 are side elevations of respectively the feed block and the friction pad of the machine shown in FIG. 1, marked up to show preferred dimensions.
Figure 11:
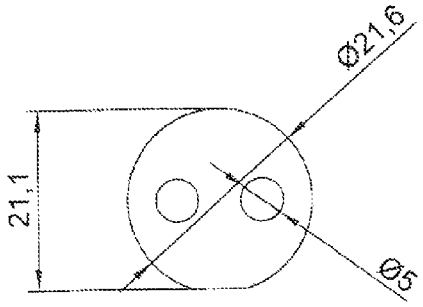

The shapes of the feed block 62 and the friction pad 66 are shown in more detail in FIGS. 7 to 9, while their particular dimensions in the illustrated embodiment are marked on FIGS. 10 and 11.

It is believed that the geometry close to the gate is most important in producing a reliable sheet feeder, i.e. one that can rapidly and consistently transport one sheet at a time through the gate without jamming. The bottom of the feed block 62 is defined by a bottom face 74 that is generally parallel to the surface of the drive belt 42. The bottom face 74 is smoothly connected to the lower portion 72 of the front face 70 by a curved transitional surface 76. As best seen in FIG. 9, the lower part of each feed block 62 takes the form of two sidewalls 78 with a recess 80 between them. The bottom face 74 of each feed block 62 therefore in fact comprises a pair of discrete surfaces on the respective sidewalls 78. The friction pad 66 is mounted in the recess 80 between the sidewalls 78 so that it projects slightly below the bottom face 74 of the feed block 62. The friction pad 66 is bounded by a generally cylindrical surface 82, except that at the lowermost part of the projecting portion, the cylindrical surface 82 is replaced by a flat surface 84 parallel to the drive belt 42. It is therefore the flat surface 84 of the friction pad 66 that defines the gate 26. The projecting portion of the friction pad 66 also comprises on its upstream side an exposed section 85 of the cylindrical surface 82 that is inclined at a sharp angle (less than 45°) to the drive belt 42. It is important to note that the friction pad 66 does not intersect the plane 86 that is defined by the lower portion 72 of the front face 70 of the feed block, as indicated by a dashed line in FIG. 7.

It is possible that the lower portion 72 of the front face of the feed block 70 may be gently curved, rather than truly straight, and therefore not define a true plane over its whole length. In that case, the plane 86 in question, which is not intersected by the friction pad 66, is that tangent to the lowest part of the lower portion 72 before it transitions into the bottom face 74 via the curved surface 76.

The friction pad 66 is formed from a resilient material such as rubber or, preferably, polyurethane. Polyurethane has been found to work with a Type A Shore hardness of 65, 80 or 90. Because the friction pad 66 is resilient rather than completely rigid, and because the geometry of the gate is important, means need to be provided to mount the pad 66 securely in the recess 80. The pad 66 is fixed at two points to prevent it pivoting. At each fixing point a horizontal bore passes through the pad 66 and is lined with a metal (e.g. steel) bush 88 that is internally threaded. Four bolts 90 are then passed through apertures in the opposing side walls 78 of the feed block 62 and are screwed into the each end of each bush 88 to secure the friction pad 66 against movement.

The feed blocks 62 may be manufactured from any suitable, rigid material, for example aluminium or an aluminium alloy. It is preferred that the surfaces of the feed blocks 62—and in particular the front surfaces 70 that contact the stack of paper—should be anodized to provide them with a smooth and durable finish.

The invention claimed is:

1. A sheet feeder comprising:

a feed deck for supporting a stack of sheets to be fed;

a feed block;

a drive belt for frictionally engaging the underside of a bottom sheet of the stack and urging the sheet below the feed block along a feed direction;

wherein the feed block comprises:

a friction pad that projects from the bottom of the feed block towards the drive belt to define a gate therebetween; and a first front face immediately upstream from the gate, the first front face defining a plane inclined at a first angle to the feed direction;

wherein the friction pad does not intersect the plane of the first front face.

2. The sheet feeder according to claim 1, wherein the first angle is less than 45°.

3. The sheet feeder according to claim 2, wherein the first angle is between 25° and 30°.

4. The sheet feeder according to claim 1, wherein the feed block further comprises a second front face upstream from the first front face, the second front face being inclined to the feed direction at a second angle that is greater than the first angle.

5. The sheet feeder according to claim 1, wherein the feed block further comprises a lower face, which is located downstream from the first front face and which faces the drive belt, the friction pad projecting from the bottom of the feed block below the lower face.

6. The sheet feeder according claim 5, wherein lower face of the feed block defines a plane that is substantially parallel to the feed direction; the feed block further comprising a curved surface that effects a smooth transition from the first front face to the lower face.

7. The sheet feeder according to claim 1, wherein the material of the friction pad is polyurethane.

8. The sheet feeder according to claim 1, wherein the material of the friction pad has a Type A Shore hardness in the range 50 to 100.

9. The sheet feeder according to claim 8, wherein the material of the friction pad has a Type A Shore hardness in the range 85 to 95.

10. The sheet feeder according to claim 1, wherein the feed block comprises a pair of sidewalls and a recess in the bottom of the feed block extending between the sidewalls, the friction pad being mounted in the recess.

11. The sheet feeder according to claim 10, wherein the friction pad comprises at least two bores therein, the friction pad being mounted in the recess by at least two fixings that pass through the sidewalls of the feed block and engage with the bores.

12. The sheet feeder according to claim 1, wherein the material of the feed block is aluminium or an aluminium alloy; and wherein at least the first front face of the feed block is anodized.

13. The sheet feeder according to claim 1, further comprising a counter-rotating pair of acceleration rollers downstream from the gate for gripping a sheet between them and accelerating the sheet away from the gate.

14. The sheet feeder according to claim 1, wherein the feed deck is inclined to the horizontal and wherein the feed deck comprises a plurality of feed rollers, each of which is free to spin about a generally horizontal axis.

15. The sheet feeder according to claim 14, further comprising at least one guide plate arranged in a vertical plane and transversely to a set of the rollers, the set of rollers defining a plane that is tangent to the tops of the rollers; wherein a lower edge of the guide plate projects below the plane between adjacent pairs of the rollers.

16. A sheet feeder comprising:

a feed deck for supporting a stack of sheets to be fed;

a feed block;

a drive belt for frictionally engaging the underside of a bottom sheet of the stack and urging the sheet below the feed block along a feed direction;

wherein the feed block comprises:

a friction pad that projects from the bottom of the feed block towards the drive belt to define a gate therebetween;

a first front face immediately upstream from the gate, the first front face defining a plane inclined at a first angle to the feed direction;

wherein the friction pad does not intersect the plane of the first front face; and wherein the friction pad comprises a pad lower face that is substantially parallel to the feed direction.

17. The sheet feeder according to claim 16, wherein the friction pad further comprises a pad front face that adjoins an upstream end of the pad lower face, the pad front face being inclined at an angle of less than 45° to the feed direction where it adjoins the pad lower face.

18. The sheet feeder according to claim 17, wherein the pad front face is part of a substantially cylindrical surface that surrounds the friction pad except in the region of the pad lower face.

19. A sheet feeder comprising:

a feed deck for supporting a stack of sheets to be fed;

a feed block;

a drive belt for frictionally engaging the underside of a bottom sheet of the stack and urging the sheet below the feed block along a feed direction;

wherein the feed block comprises:

a friction pad that projects from the bottom of the feed block towards the drive belt to define a gate therebetween;

a first front face immediately upstream from the gate, the first front face defining a plane inclined at a first angle to the feed direction;

wherein the friction pad does not intersect the plane of the first front face; and comprising a pair of the drive belts positioned on opposite sides of a centreline of the feeder and pair of the feed block aligned with respective ones of the drive belts.

20. The sheet feeder according to claim 19, wherein the pair of feed blocks are mounted on a common bracket, which is in turn mounted on a frame of the sheet feeder.

21. The sheet feeder according to claim 20, further comprising means for adjusting the height of at least one of the feed blocks relative to the bracket.

22. The sheet feeder according to claim 20, further comprising means for adjusting the height of the bracket relative to the frame.

* * * * *